US009834414B2

(12) United States Patent
Wang

(10) Patent No.: US 9,834,414 B2
(45) Date of Patent: Dec. 5, 2017

(54) SYSTEM AND METHOD FOR CONTROLLING ELEVATOR DOOR SYSTEMS

(71) Applicant: Mitsubishi Electric Research Laboratories, Inc., Cambridge, MA (US)

(72) Inventor: Yebin Wang, Acton, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 364 days.

(21) Appl. No.: 14/742,057

(22) Filed: Jun. 17, 2015

(65) Prior Publication Data

US 2016/0368739 A1 Dec. 22, 2016

(51) Int. Cl.
*B66B 13/14* (2006.01)

(52) U.S. Cl.
CPC ..... *B66B 13/146* (2013.01)

(58) Field of Classification Search
CPC ..... B66B 13/146
USPC ..... 187/317
See application file for complete search history.

(56) References Cited

U.S. PATENT DOCUMENTS

| | | | | |
|---|---|---|---|---|
| 5,274,312 | A | 12/1993 | Gerstenkorn | |
| 8,183,815 | B2 | 5/2012 | Krause et al. | |
| 2007/0016332 | A1* | 1/2007 | Tyni | B66B 5/0037 700/275 |
| 2008/0179143 | A1* | 7/2008 | Tyni | B66B 13/143 187/316 |
| 2016/0368739 | A1* | 12/2016 | Wang | B66B 13/146 |

FOREIGN PATENT DOCUMENTS

| | | | | |
|---|---|---|---|---|
| DE | 102014201399 | A1 * | 7/2015 | B66B 13/146 |
| JP | 2017007862 | A * | 1/2017 | B66B 13/146 |

* cited by examiner

*Primary Examiner* — David Warren
(74) *Attorney, Agent, or Firm* — Gene Vinokur; James McAleenan; Hironori Tsukamoto

(57) ABSTRACT

A method controls the operation of the door system using one or combination of parameters of a reduced order model of the door system. The operation includes moving at least one door of the door system. The method measures a signal representing the operation of the door system and filters the measured signal by removing at least one dynamic of the measured signal absent from a frequency response of the reduced order model of the door system. The method also updates parameters of the reduced order model of the door system to reduce an error between the filtered signal and an estimated signal of the operation estimated using the updated reduced order model of the door system. The parameters of the reduced order model include a mass parameter and a friction parameter.

20 Claims, 15 Drawing Sheets

SYSTEM AND METHOD FOR CONTROLLING ELEVATOR DOOR SYSTEMS

FIELD OF INVENTION

This invention relates generally to elevator systems, and more particularly to controlling elevator door systems.

BACKGROUND OF INVENTION

Automatic sliding doors used in high performance elevators must meet various operating regulations. For example, to protect against wedging, it is required that a maximal movement energy of all parts connected together mechanically do not exceed a preset maximum value (for example 10 joules) at a mean closing speed. This requirement sets an upper limit value for the mean closing speed. On the other hand, short door closing times are a prerequisite for good transport performance in high performance elevators. The mass of the elevator doors is related to the kinetic energy of the elevator door system, and, thus, needs to be determined.

Similarly, a control module in the elevator door system controls the motion of the elevator door using an electric motor as an actuator. To improve ride comfort of passengers, it is desirable to operate the elevator door movement smoothly. Hence, the control module needs to reduce vibration and noise while opening and closing the elevator door. The control module controls the motion of the elevator door according to at least the mass of the elevator door, which also necessitates the knowledge of the mass of the doors.

Different methods have been used to determine the mass of the doors in the elevator system. For example, one method weighs the doors of the elevator system before commissioning the elevator system. However, the weight of the door can change over time in many cases. For example, customers may change the decoration of the doors that affect its weight. Thus, there is a need to determine the mass of the elevator door online during the operation of the elevator system.

Another method estimates the mass of the elevator door based on a linear static model, which represents the relationship between a translational acceleration of the door and a torque of the electric motor moving the door. However, the linear static model fails to capture various physical factors affecting the movement of the door. For example, the linear static models do not take into consideration friction forces affecting dynamics of the elevator door system, and thus can produce an inaccurate estimation of the door mass. In addition, the existing methods generally estimate the mass of the elevator doors offline.

SUMMARY OF INVENTION

Some embodiments of the invention are based on recognition that the mass of the doors and/or other parameters of the elevator door system can be recursively estimated by analyzing and utilizing dynamic behavior of the door system. For example, a comparison between performances of the elevator door system estimated based on a model of the door system and measured during the operation of the door system can be used to determine parameters of the model, such as a mass of the elevator door. However, the dynamics of the elevator door system are complex and the model of the door system includes high order differential equations and numerous model parameters. To that end, identification of all parameters of the model necessarily requires persistent excitation conditions of the operation of the door system, which can lead to undesirable vibration. Therefore, it is impractical to perform parameter identification of the full model parameters of the elevator door system based on routine operations of the door system.

Some embodiments of the invention are based on another recognition that it is possible to concurrently reduce the order of the model of the elevator door system and reduce the complexity of the measured signal by filtering out the harmonics not represented by the reduced order model. In such a manner, the complexity of the calculation is reduced without significant drop in accuracy, but the reduction of the complexity allows estimation of the parameters of the system in real time.

For example, the frequency response of the reduced order model can approximate a dominant frequency response of a higher order model of the door system. The approximation reduces the number of parameters to be identified to a subset of dominant parameters of the higher order model. For example, the reduced order model can be a second order model. However, the model reduction results in the mismatch between harmonics of the signal representing the actual operation of the door system and harmonics of the frequency response of the reduced order model, which can lead inaccurate estimation of the parameters of the reduced order model. Accordingly, some embodiments of the invention remove the undesirable harmonics of the signal absent from a frequency response of the reduced order model to match the harmonics of the filtered signal to the frequency response of the reduced order model. Such a joint reduction allows recursively updating parameters of the reduced order model by reducing an error between filtered measured signals and signals estimated on the basis of the reduced order model with updated parameters.

Accordingly, one embodiment of an invention discloses a method for controlling an operation of a door system of an elevator system arranged in a building. The method includes controlling the operation of the door system using one or combination of parameters of a reduced order model of the door system, wherein the operation includes moving at least one door of the door system; measuring a signal representing the operation of the door system; filtering the measured signal by removing at least one dynamic of the measured signal absent from a frequency response of the reduced order model of the door system; and updating parameters of the reduced order model of the door system to reduce an error between the filtered signal and an estimated signal of the operation estimated using the updated reduced order model of the door system, wherein the parameters of the reduced order model include a mass parameter and a friction parameter. The steps of the method are performed by a processor.

Another embodiment discloses an elevator door system, including a motor and a pulley; a cabin door guarding an entrance to an elevator car; a landing door guarding an entrance to an elevator shaft, wherein the motor drives the pulley to move the cabin door using a belt, and wherein the cabin door is mechanically connected to the landing door for a period of time during an operation of the elevator door system; sensors for measuring a signal representing the operation of the door system; a filter for filtering the signal by removing at least one dynamic of the measured signal absent from a frequency response of a reduced order model of the elevator door system, wherein the frequency response of the reduced order model approximates a dominant frequency response of a higher order model of the door system; and a controller for controlling the operation of the elevator door system using the reduced order model of the elevator door system, wherein the controller updates parameter of the reduced order model to reduce an error between the filtered signal and an estimated signal of the operation estimated using the updated reduced order model of the door system.

Yet another embodiment discloses a method for controlling an operation of a door system of an elevator arranged in a building, wherein the door system includes a motor, a pulley, an elevator door guarding an entrance to an elevator car and a floor door guarding an entrance to a floor of the building, wherein the motor drives the pulley to move the elevator door, and wherein the elevator door is mechanically connected to the floor door when the elevator car stops at the floor of the building to move the floor door. The method includes controlling the operation of the door system for an operating cycle using one or combination of parameters of a reduced order model of the door system, wherein the operating cycle includes one or combination of opening and closing the elevator and the floor doors; measuring a signal of the operation of the door system; filtering the signal by removing at least one dynamic of the measured signal absent from a frequency response of the reduced order model of the door system, wherein the frequency response of the reduced order model approximates a dominant frequency response of a higher order model of the door system; and updating parameters of the reduced order model of the door system to reduce an error between the filtered signal and a signal of the operation estimated using the updated reduced order model of the door system, wherein the parameters of the reduced order model include a mass parameter and a friction parameter.

DETAILED DESCRIPTION OF EMBODIMENTS OF INVENTION

Figure 1A:
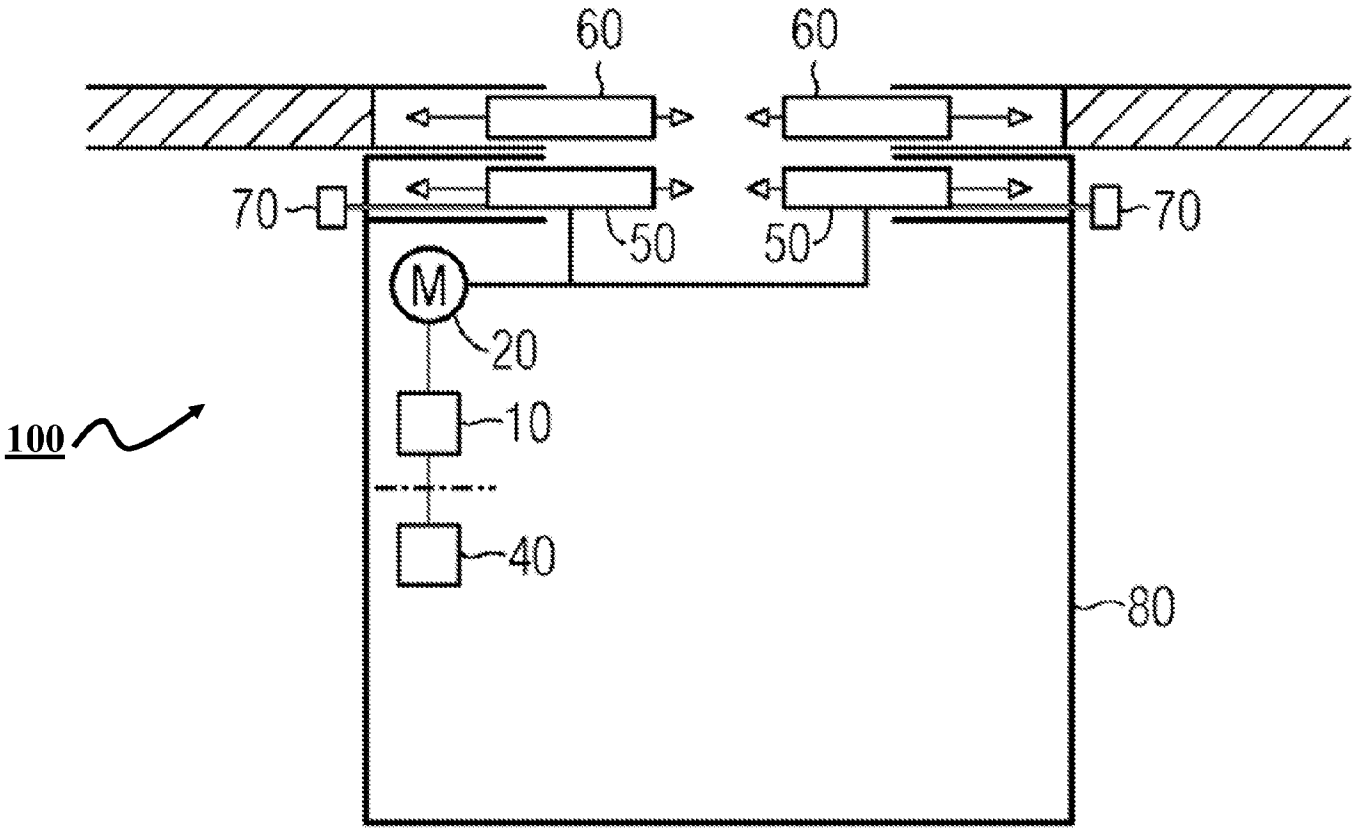
FIG. 1A is a block diagram of a door system of an elevator according to some embodiments of an invention.

FIG. 1A shows a block diagram of a door system 100 of an elevator according to some embodiments of an invention. The door system 100 includes a controller 10, which is connected to a motor 20 and to a hand terminal 40. Further, the door system 100 includes a two-part cabin door 50 and balancing weights 70. Landing doors 60, which are arranged at various floors to guard the elevator shaft, are mechanically connected to the cabin door 50 of the elevator car 80. For example, the cabin door can have a clutch mechanism that unlocks and moves the landing door at each floor.

Figure 1B:
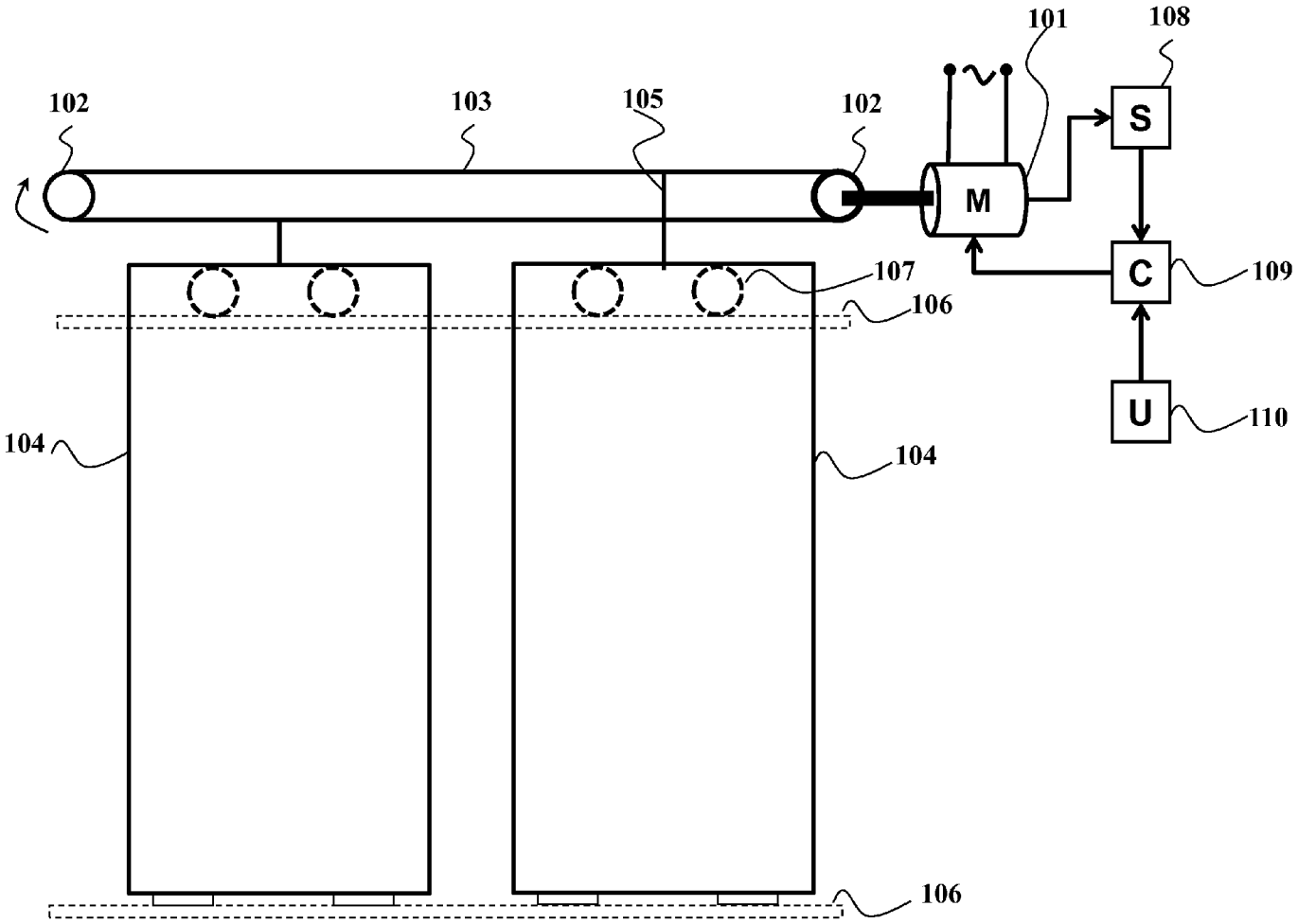
FIG. 1B is a schematic of components of an elevator door system arranged to control the movement of the elevator doors according to another embodiment of the invention.

FIG. 1B shows a schematic of components of an elevator door system arranged to control the movement of the elevator doors according to another embodiment of the invention. The components include an electric motor (M) 101, pulleys 102, a belt 103 and a coupling mechanism 105 between the belt 103 and the elevator door 104. The electric motor 101, controlled by a control module (C) 109 according to signals measured by sensors (S) 108 and operation commands (U) 110 from passengers, rotates and drives the pulleys 102, which consequently generates a translational movement of the belt 103. The moving belt further leads to the translational movement (open or close) of the elevator door 104 through the coupling mechanism 105. The elevator door moves along the rails 106 and rollers 107. Alternative embodiments use different implementations of the elevator door system. For example, the doors of the elevator door system can be implemented as a single door leaf, a double door leaf and a rolling door with closing and opening directions in any desired positions.

Some embodiments of the invention are based on recognition that the mass of the doors and/or other parameters of the elevator door system can be recursively estimated by analyzing and utilizing dynamic behavior of the door system. For example, a comparison between performances of the elevator door system estimated based on a model of the door system and measured during the operation of the door system can be used to determine parameters of the model, such as a mass of the elevator door.

However, the dynamics of the elevator door system are complex and the model of the door system includes high order differential equations and numerous model parameters. For example, the full model of the elevator door system can include eight first order differential equations (DEs), i.e., an eighth order model. To that end, identification of all parameters of the model necessarily requires persistent excitation conditions of the operation of the door system, which can lead to undesirable vibration. The persistent excitation conditions typically cannot be satisfied during routine operation of the door system. Therefore, it can be difficult to perform parameter identification of the full model of the elevator door system based on routine operations of the door system.

Some embodiments of the invention are based on another recognition that it is possible to concurrently reduce one order of the model of the elevator door system and reduce the complexity of the measured signal by filtering out the harmonics not represented by the reduced order model. Estimation of model parameters can be performed by comparing the reduced order model and the filtered measured signals according certain criteria. The reduced order model parameters can be estimated from routine operation of the door system. In such a manner, not only the complexity of the calculation is reduced without significant drop in accuracy, but also the reduction of the complexity allows estimation of the parameters of the system in real time.

For example, the frequency response of the reduced order model can approximate a dominant frequency response of a higher order model of the door system. The approximation reduces the number of parameters to be identified to a subset of dominant parameters of the higher order model. For example, the reduced order model can be a second order model. However, the model reduction results in the mismatch between harmonics of the signal representing the actual operation of the door system and harmonics of the frequency response of the reduced order model, which can lead to inaccurate estimation of the parameters of the reduced order model. Accordingly, some embodiments of the invention remove the undesirable harmonics of the measured signal absent from a frequency response of the reduced order model so that the harmonics of the filtered signal match the frequency response of the reduced order model. Such a joint reduction allows recursively updating parameters of the reduced order model by reducing an error between filtered measured signals and signals estimated by the reduced order model with updated parameters.

Figure 2:
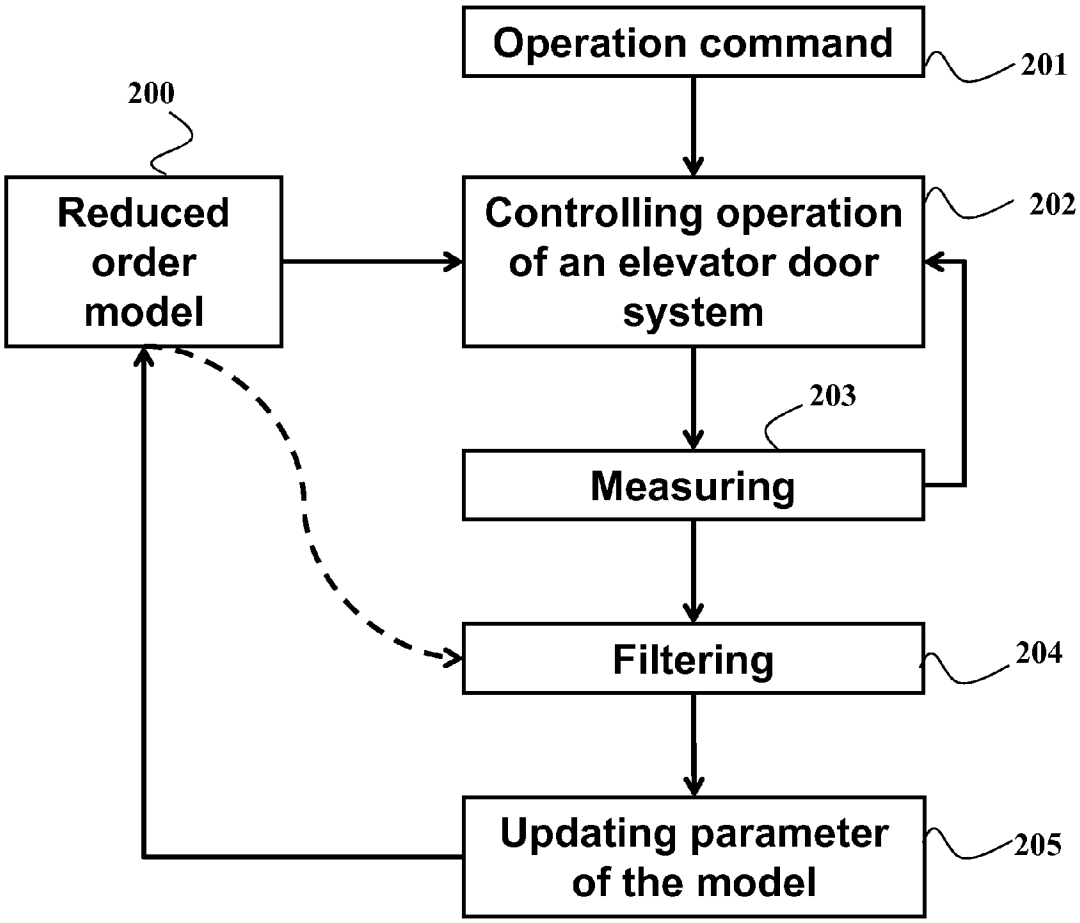
FIG. 2 is a block diagram of a method for controlling an operation of a door system according to one embodiment of the invention.

FIG. 2 shows a block diagram of a method for controlling an operation of a door system of an elevator arranged in a building according to one embodiment of the invention. The steps of the method are performed by a processor of, e.g., a processor of the control module 109. The embodiment controls 202 the operation of the door system, e.g., according to an operation command 201, using one or combination of parameters of a reduced order model 200 of the door system and a measured signal 203 representing the operation of the door system. For example, the parameters of the reduced order model include a mass parameter and a friction parameter. The signal can be a torque of a motor for moving the door and/or an acceleration of the movement of the door. The operation command 201 can be received from passengers of the elevator or an external system. The operation includes movement of at least one door of the door system.

The embodiment filters 204 the measured signal by removing at least one dynamic of the measured signal absent from a frequency response of the reduced order model of the door system. The frequency response of the reduced order model approximates a dominant frequency response of a higher order model of the door system, and the filtering matches the harmonics of the filtered signal to the frequency response of the reduced order model. Next, the embodiment updates 205 parameters of the reduced order model of the door system to reduce an error between the filtered signal and a signal of the operation estimated using the updated reduced order model of the door system. In some implementations of the embodiment, the parameters are updated recursively. Also, the filtering 204 can produce the filtered signals for the updating 205.

Figure 3A:
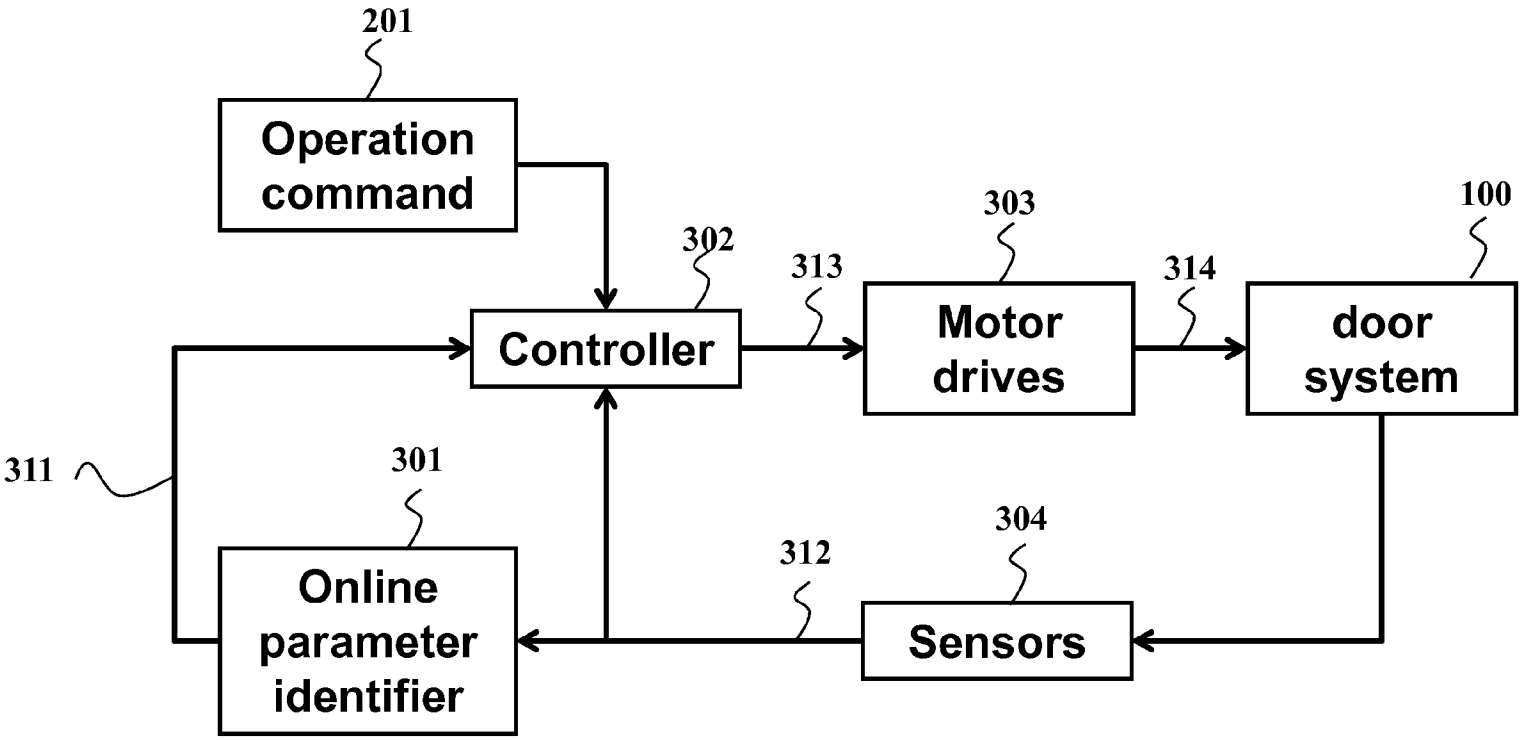
FIG. 3A is a block diagram of the elevator door system according to one embodiment of the invention.

FIG. 3A shows a block diagram of the elevator door system according to one embodiment of the invention. In this embodiment, a controller 302 and motor drives 303 are components for controlling 202 the operations of the elevator door system. The elevator door system also includes sensors 304 for measuring 203 the signals reflecting the operation of the elevator door system, a processor executing an online parameter identifier 301 module for determining parameters of the reduced order model of the elevator door system.

For example, the controller 302 determines the commands for the motor drives, represented by desired voltages or currents of the electric motor, according to the parameters of the reduced order model of the elevator door system, measured signals 312, and the operation command 201. The measured signals 312 can include a position signal from an encoder of the electric motor, and current signals of the electric motor from current sensors. Current signals can be used to compute a torque signal which is generated by the electric motor to drive the elevator door.

Figure 3B:
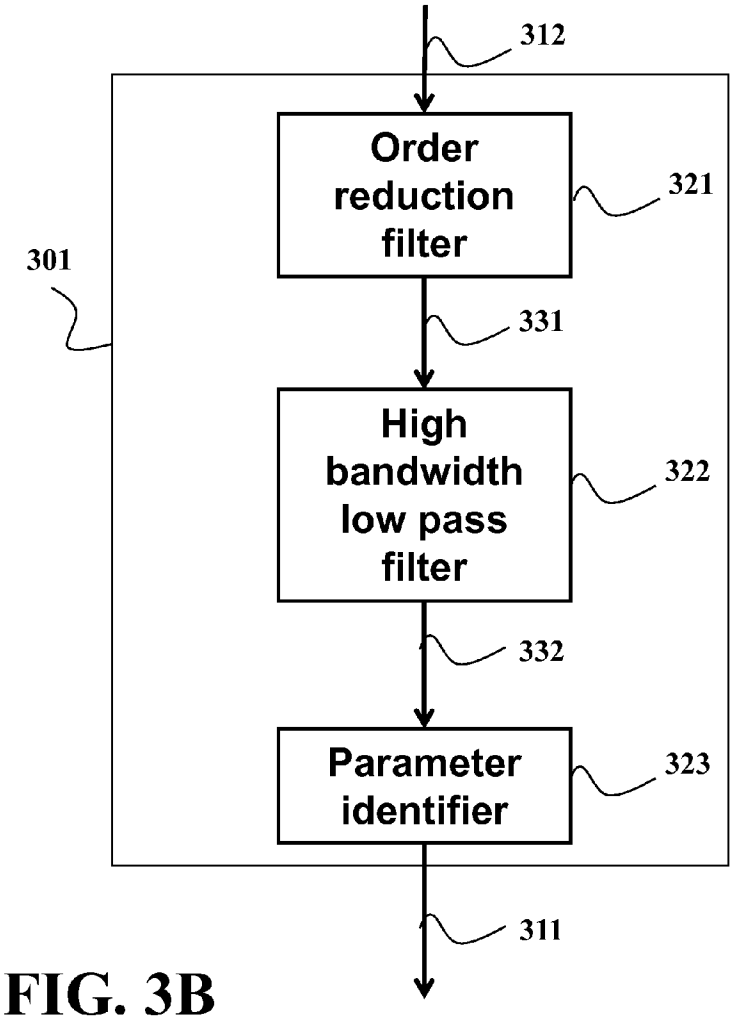
FIG. 3B is a block diagram of an online parameter identifier according to one embodiment of the invention.

FIG. 3B shows a block diagram of the online parameter identifier 301 according to one embodiment of the invention. The online parameter identifier 301 filters the measured signal 312 by an order reduction filter 321 to produce a filtered position and a filtered torque signal 331 which are further applied as inputs of a high bandwidth low pass filter 322 to produce a filtered acceleration, a filtered velocity, a second filtered position, and a second filtered torque signal 332.

A parameter identifier 323 updates and outputs parameter 311 of the reduced order model based on the filter signals 332. For example, the parameter identifier 323 solves a least squares problem to reduce the error between the filter signal and an estimated signal of the operation estimated using the updated reduced order model of the door system. For example, the parameter identifier solves a least squares problem reducing the error between an estimated position of the door and the filtered position of the door, between an estimated acceleration of the door and the filtered acceleration of the door, between an estimated velocity of the door and the filtered velocity of the door, and between an estimated torque of the motor and the filtered torque of the motor.

Figure 3C:
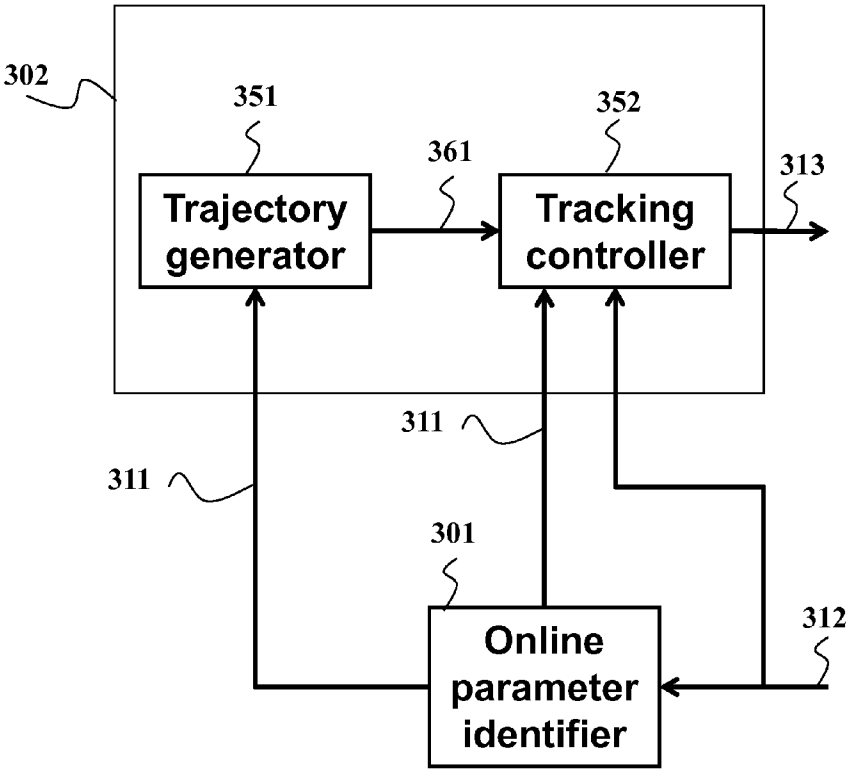
FIG. 3C is a block diagram of a method for controlling the operation of the elevator door system according to one embodiment of the invention.

FIG. 3C shows a block diagram of controlling operation of the elevator door system according to one embodiment of the invention. The parameters 311 determined by the online parameter identifier 301 are used by a trajectory generator 351 to plan a smooth trajectory 361 of the elevator door for each mode of the operation, e.g., close or open the door, to suppress vibration and noise. The trajectory 361 is a set of points describing the position/velocity of the elevator door over time, and uniquely defines how the elevator door moves for each cycle of close/open operation. The parameter estimates 311 can also be used by a tracking controller 352 that generates control commands to the motor drives so that the actual movement of the elevator door tracks the planned trajectory 361 in real-time.

In some implementations, the trajectory generator uses the updated parameters 311 for planning the entire cycle of the trajectory. In contrast, the tracking controller can use the parameters 311 updated for each time step of the control, e.g., as fast as the online parameter identifier 301 outputs the updated parameters. The trajectory generator can also use the update parameters 311 for each step of the control for updating the trajectory 361.

Some embodiments of the invention concurrently reduce the order of the model of the elevator door system that allows estimation of the parameters of the system in real time. For example, a higher order model of the door system is simplified such that the frequency response of the reduced order model approximates a dominant frequency response of the higher order model of the door system.

Figure 4A:
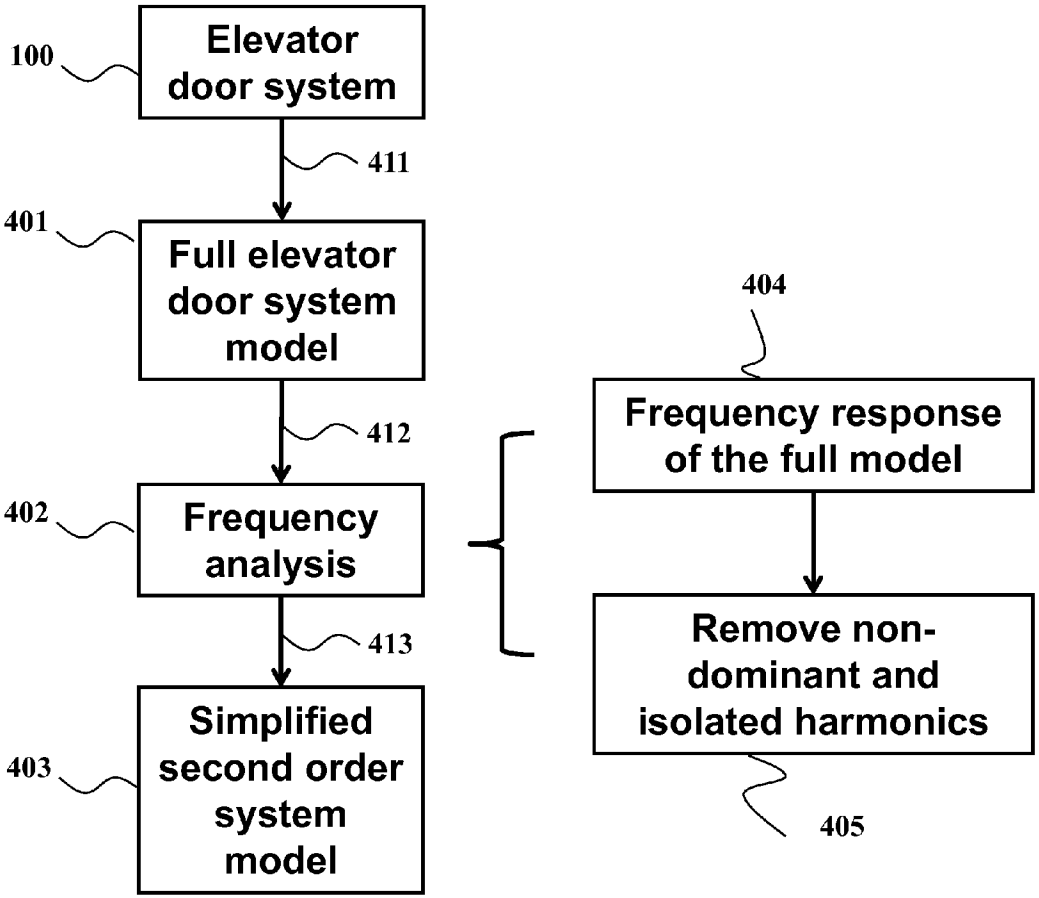
FIG. 4A is a block diagram of a method for reducing an order of the model of the elevator door system according to one embodiment of the invention.

FIG. 4A shows a block diagram of a method for reducing order of the model of the elevator door system according to one embodiment of the invention. The embodiment constructs 411 the full model 401 of the elevator door system 100 based on several assumptions, as described below. Then the frequency analysis 402 is conducted 412 based on the full elevator door system model 401 to produce 413 a simplified second order system model 403. In some embodiments, the frequency analysis includes elimination of non-dominant and isolated harmonics 405 from the frequency response of the full elevator door system model 404.

Figure 4B:
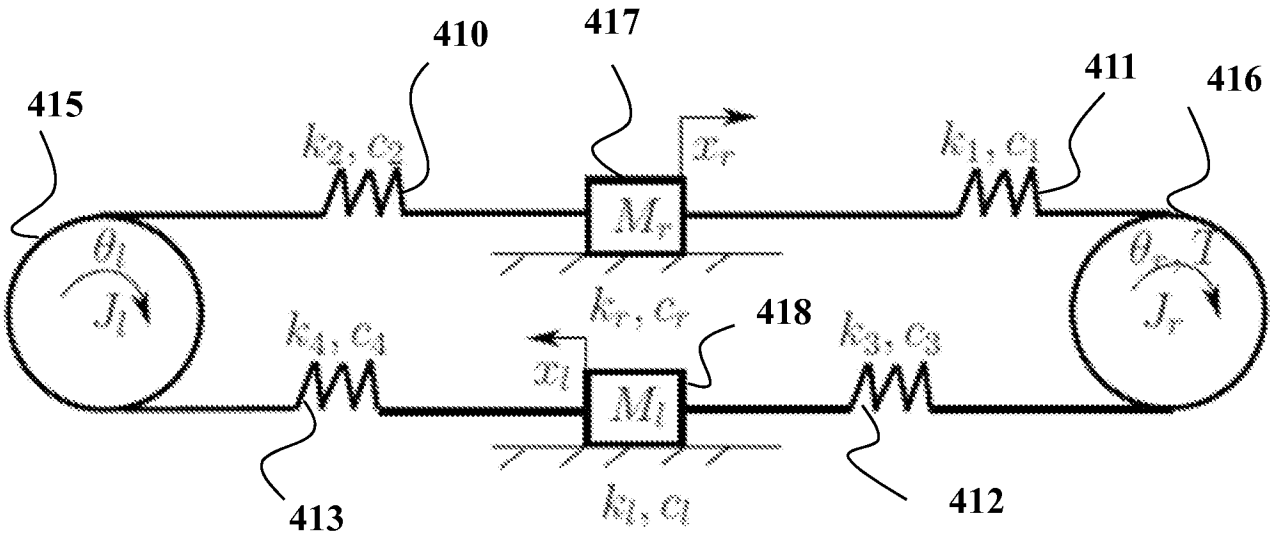
FIG. 4B is an example of the full model of the elevator door system determined by one embodiment of the invention.

FIG. 4B shows an example of the full model 401 of the elevator door system determined by one embodiment of the invention by treating belts as springs 410, 411, 412, 413 and by treating pulley 415, 416 and elevator door panels 417, 418 as rigid body.

Assuming no slip between pulleys and the belt, a full elevator door system model can be written as follows $$M_r\ddot{x}=k_1(R\theta_r-x_r)+c_1(R\dot{\theta}_r-\dot{x}_r)+k_2(R\theta_l-x_r)+c_2(R\dot{\theta}_l-\dot{x}_r)+k_rx_r+C_r\dot{x}_r,$$

$$(M_l+M_n)\ddot{x}_l=k_4(R\theta_l-x_l)+c_4(R\dot{\theta}_l-\dot{x}_l)+k_3(R\theta_r-x_l)+c_3(R\dot{\theta}_r-\dot{x}_r)+k_lx_l+c_l\dot{x}_l,$$

$$J_r\ddot{\theta}_r=Rk_3(x_1-R\theta_r)+Rc_3(\dot{x}_r-R\dot{\theta}_r)+Rk_1(x_r-R\theta_r)+Rc_1(\dot{x}_r-R\dot{\theta}_r)+T,$$

$$J_l\ddot{\theta}_l=Rk_2(x_r-R\theta_l)+Rc_2(\dot{x}_r-R\theta_l)+Rk_4(x_l-R\theta_l)+Rc_4(\dot{x}_l-R\dot{\theta}_l),$$

where T is the motor torque, M is the mass of the elevator door panels, J is the inertia of the pulleys, x is the position of the elevator door panels, θ is the rotation angle of pulleys, and subscripts r and l represent the right and left, respectively, and dots represent derivatives.

With $k_i=k_j, c_i=c_j$, $1\le i,j\le 4$, the stiffness and damping coefficients, the 8th-order dynamics are further written in state space form $$\begin{aligned}
\dot{x}_1 &= x_5,\\
\dot{x}_2 &= x_6,\\
\dot{x}_3 &= x_7,\\
\dot{x}_4 &= x_8,\\
\dot{x}_5 &= \frac{1}{M_r}\begin{pmatrix} -(2k_1+k_r)x_1-(2c_1+c_r)x_5+ \\ k_1R(x_3+x_4)+c_1R(x_7+x_8)\end{pmatrix},\\
&= \frac{1}{M_r}\begin{pmatrix} -(2k_1+k_r)x_1+k_1Rx_3+k_1Rx_4- \\ (2c_1+c_r)x_5+c_1Rx_7+c_1Rx_8\end{pmatrix},\\
\dot{x}_6 &= \frac{1}{M_l+M_n}\begin{pmatrix} -(2k_1+k_l)x_2-(2c_1+c_l)x_6+ \\ k_1R(x_3+x_4)+c_1R(x_7+x_8)\end{pmatrix},\\
&= \frac{1}{M_l+M_n}\begin{pmatrix} -(2k_1+k_l)x_2+k_1Rx_3+ \\ k_1Rx_4-(2c_1+c_l)x_6+c_1Rx_7+c_1Rx_8\end{pmatrix},\\
\dot{x}_7 &= \frac{1}{J_r}\begin{pmatrix} -2k_1R^2x_3-2c_1Rx_7+ \\ Rk_1(x_1+x_2)+Rc_1(x_5+x_6)+T\end{pmatrix},\\
&= \frac{1}{J_r}\begin{pmatrix} Rk_1x_1+Rk_1x_2-2k_1R^2x_3+ \\ Rc_1x_5+Rc_1x_6-2c_1Rx_7+T\end{pmatrix},\\
\dot{x}_8 &= \frac{1}{J_l}\begin{pmatrix} -2k_1R^2x_4-2c_1Rx_8+ \\ Rk_1(x_1+x_2)+Rc_1(x_5+x_6)\end{pmatrix}\\
&= \frac{1}{J_l}\begin{pmatrix} Rk_1x_1+Rk_1x_2-2k_1R^2x_4+ \\ Rc_1x_5+Rc_1x_6-2c_1Rx_8\end{pmatrix}\Bigg),\\
y &= (x_1, x_2)^T,
\end{aligned} \tag{1}$$

where $x_1=x_r, x_2=x_l, x_3=\theta_r, x_4=\theta_l$.

Simplify the notation $M_l:M_l+M_n$. The model (1) is abbreviated as follows $$\begin{aligned}
\dot{x} &= Ax+Bu,\\
y &= Cx,
\end{aligned} \tag{2}$$

where $x=(x_1, \ldots, x_8)^T$, and $$A=\begin{bmatrix}
0 & 0 & 0 & 0 & 1 & 0 & 0 & 0\\
0 & 0 & 0 & 0 & 0 & 1 & 0 & 0\\
0 & 0 & 0 & 0 & 0 & 0 & 1 & 0\\
0 & 0 & 0 & 0 & 0 & 0 & 0 & 1\\
\frac{-(2k_1+k_r)}{M_r} & 0 & \frac{k_1R}{M_r} & \frac{k_1R}{M_r} & \frac{-(2c_1+c_r)}{M_r} & 0 & \frac{c_1R}{M_r} & \frac{c_1R}{M_r}\\
0 & \frac{-(2k_1+k_l)}{M_l} & \frac{k_1R}{M_l} & \frac{k_1R}{M_l} & 0 & \frac{-(2c_1+c_l)}{M_l} & \frac{c_1R}{M_l} & \frac{c_1R}{M_l}\\
\frac{Rk_1}{J_r} & \frac{Rk_1}{J_r} & \frac{-2k_1R^2}{J_r} & 0 & \frac{Rc_1}{J_r} & \frac{Rc_1}{J_r} & \frac{-2c_1R}{J_r} & 0\\
\frac{Rk_1}{J_l} & \frac{Rk_1}{J_l} & 0 & \frac{-2k_1R^2}{J_l} & \frac{Rc_1}{J_l} & \frac{Rc_1}{J_l} & 0 & \frac{-2c_1R}{J_l}
\end{bmatrix}, \quad \text{i.}$$

$$B=\left[0,\ 0,\ 0,\ 0,\ 0,\ 0,\ \frac{1}{J_r},\ 0\right]^T,$$

$$C=\begin{bmatrix} 1 & 0 & 0 & 0 & 0 & 0 & 0 & 0\\ 0 & 1 & 0 & 0 & 0 & 0 & 0 & 0\end{bmatrix}.$$

The frequency analysis 402 performed by some embodiments demonstrates that the full elevator door system model can be reduced to a simplified second or forth order model. Moreover, such a reduced order model is sufficiently accurate for determining mass of the elevator door and other parameters of the elevator door system. As an example, one embodiment uses the following parameter values of the elevator door system during frequency analysis.

TABLE 1

Notations

| Notation | Description |
|---|---|
| $M_r$ | mass of right door |
| $M_l$ | mass of left door and hall panel |
| $J_r$ | inertia of right pulley |
| $J_l$ | inertia of left pulley |
| R | radius of pulleys |
| $k_1$ | belt stiffness |
| $c_1$ | belt damping |
| $k_r$ | stiffness |
| $c_r$ | damping between guide rail and door panels |

Figure 4C:
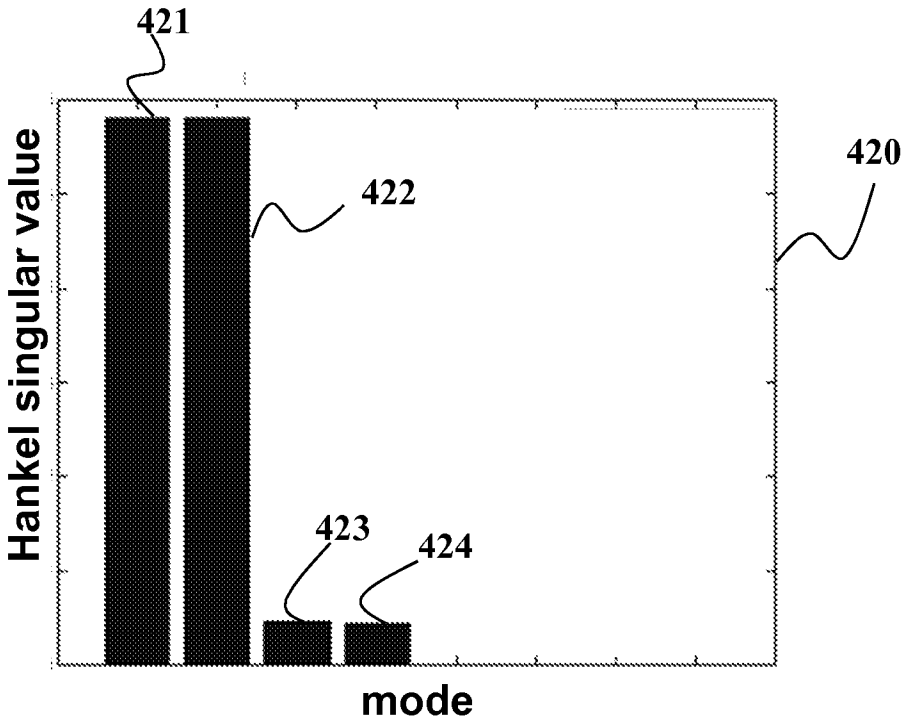
FIG. 4C is a Hankel singular value plot 420 of the frequency analysis of the model of the system used by some embodiments of the invention.

In this case, $M_r$, $M_l$ are symmetric, thus $y_1=x_r$ and $y_2=x_l$ have the same transfer functions $$G(s) = \frac{k(s^2+\omega_4^2)}{(s^2+2\zeta_{1\omega_1}s+\omega_1^2))(s^2+2\zeta_2\omega_2 s+\omega_2^2)(s^2+2\zeta\omega_3 s+\omega_3^2)}$$

where k is a constant gain. FIG. 4C shows a Hankel singular value plot 420 of G(s) of the frequency analysis of the model of the system. Some embodiments are based on the following observation from the plot 420. The part $s^2+\omega_4^2$ corresponds to a frequency which is far from the frequency of interest, the frequency characterizing important physical parameters of the door, and thus can be ignored. The first four states 421, 422, 423, and 424 of the plot 420 have significantly larger energy than the other states. Therefore, the full elevator door system model can be reduced to 2nd or 4th order.

The states 421 and 422 correspond to $s^2+2\zeta_2\omega_2 s+\omega_2^2$, and the states 423 and 424 correspond to $s^2+2\zeta_1\omega_1 s+\omega_1^2$. A transfer function including the four states, corresponding to a reduced forth order model, is $$G_4(s) = \frac{k}{(s^2+2\zeta_1\omega_1 s+\omega_1^2)(s^2+2\zeta_2\omega_2 s+\omega_2^2)}.$$

The first two states 421 and 422 are far from the frequency range of, and thus ignored by some embodiments. The transfer function G(s) can be further reduced to a reduced second order model:

$$G_2(s) = \frac{k}{\omega_2^2(s^2+2\zeta_1\omega_1 s+\omega_1^2)}.$$

Figure 4D:
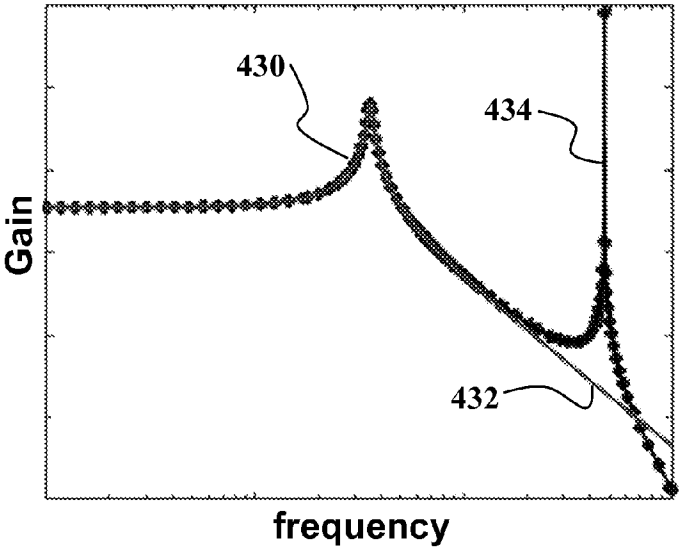
FIG. 4D is a plot with frequency responses of the full elevator door system model and a second order model according to one embodiment of the invention.

FIG. 4D shows a plot with frequency responses of transfer functions G(s) 430, $G_2(s)$ 432, and $G_4(s)$ 434 showing that the full elevator door system model, without the coulomb friction effect, can be captured fairly well by a simplified second order model. The second order transfer function $G_2$ (s) represents a mass-spring-damper system:

$$\dot{x}_1=x_2,$$
$$\dot{x}_2=-d_1x_2-kx_1+bu,$$
$$y=x_1, \tag{3}$$

with appropriate values of $d_1$, k, b, wherein $d_1$, k, b typically represent viscous damping coefficient, stiffness, and control gain constant, respectively.

Some embodiments of the invention determine the parameters $d_1$, k, b in the second order model. In addition, some embodiments establish a relationship between parameters $d_1$, k, b and the parameters of the actual, i.e., physical, elevator door system, such as door mass.

Figure 4E:
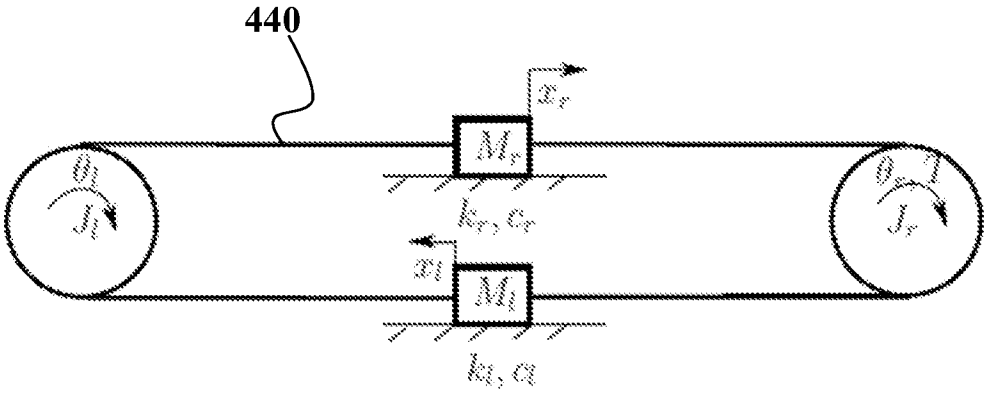
FIG. 4E is a schematic of the reduced order model of the elevator door system according to one embodiment of the invention

FIG. 4E shows a schematic of the reduced order model 440 of the elevator door system according to one embodiment of the invention. This embodiment used the following interpretation of frequency analysis results to approximate the relationship between the parameters of the model and actual parameters. First, the dynamics of the pulley are non-dominant, and can be omitted due to low energy in the 5-8 states in FIG. 4B. Second, the belt can be treated as rigid body because the associated dynamics have a resonant frequency, which is much higher than (or isolated from) the dominant frequency.

Based on the aforementioned model reduction results, the order reduction filter is designed to remove harmonics with frequencies higher than the dominant frequency, but to keep the dominant frequency as much as possible. In one embodiment, the order reduction filter is a low pass filter. Given the knowledge of the dominant frequency (or the bandwidth of the low-pass filter), different signal processing methods are used by various embodiments to design the order reduction filter to preserve the dominant frequency according to the frequency analysis results.

According the frequency analysis, the mechanical subsystem of the elevator door system, if ignoring the coulomb friction effect, can be simplified as a second order mass-spring-damper system (3). With the coulomb friction effect, between door panels and its rails, modeled as $-d_0\ \mathrm{sgn}(x_2)$ where sgn(.) is a sign function and $\mathrm{sgn}(x_2)>0$ for $x_2>0$, one embodiment of the simplified second order model of the elevator door system is given as follows $$\dot{x}_1=x_2,$$
$$\dot{x}_2=-d_0-d_1x_2-kx_1+bu,$$
$$y=x_1, \tag{4}$$

where $x_1$ and $x_2$ are the position and velocity of the elevator door, respectively, u is the control input (electric motor torque), $d_0$ denotes the static coulomb friction force, $d_1$ the viscous damping coefficient, k the stiffness, and b is the control gain constant. Note that assuming $\mathrm{sgn}(x_2)>0$ is without loss of generality. All parameters $d_0,d_1>0,k,b>0$ are unknown and to be identified. The model (4) is valid under the assumption that the linkage between the motor drive and the elevator door is rigid, i.e., no deformation or relative movement.

Some embodiments assume parameters $d_1,d_2$ and b are the same during the opening and closing operations of the elevator door. Thus the sampled data whiling opening the door are useful to identify parameters $d_1,d_0,k,b$.

Another embodiment of the reduced order model is based on recognition that modelling the spring force as a linear function of the door position, i.e., $kx_1$ is inaccurate due to factors such as elastic belts. Accordingly, the embodiment address this issue in another simplified second model of the elevator door system as follows $$\dot{x}_1=x_2,$$

$$\dot{x}_2=-d_0-d_1x_2-k\mathrm{sat}(x_1)+bu,$$

$$y=x_1, \tag{5}$$

where sat is a saturation function.

Another embodiment further neglects the spring force from the model (4), which yields the following simplified second order model $$\dot{x}_1=x_2,$$

$$\dot{x}_2=-d_0-d_1x_2+bu,$$

$$y=x_1, \tag{6}$$

In some implementations, the elevator door system has a switching feature due to different dynamics of movement of the cabin and the landing doors. That is, the model parameter values are different over different periods of time. If model (6) is appropriate for no-switching case, the switching dynamics and the corresponding reduced order model of the elevator door system for the switching case can be written as follows $$\dot{x}_1=x_2,$$

$$\dot{x}_2=-d_{01}-d_{11}x_2+b_1u,$$

$$y=x_1, \tag{7}$$

for $0\le t\le t_1$, and $$\dot{x}_1=x_2,$$

$$\dot{x}_2=-d_{02}-d_{12}x_2+b_2u,$$

$$y=x_1, \tag{8}$$

for $t_1\le t\le t_f$, where $t_f$ is the time duration of one open or close cycle of the elevator door, $t_1$ is the time instant when the switch happens.

Some embodiments formulate model parameter estimation as a least squares problem. For example, the reduced second order model of the elevator door system of FIG. 4E can be further simplified under assumption of the symmetry of the elevator door system, i.e., $k_r=k_l=0$, $M_r=M_l$ and $c_l=c_r$. The symmetry of the elevator door system allows deriving the simplified second order model as follows $$(MR^2+J)\ddot{x}(t)=Ru+d_1R^2\dot{x}+R^2d_0, \tag{9}$$

where x is the filtered position signal output from the order reduction filter, u the filtered motor torque signal output from the order reduction filter, $M=M_r+M_l$, $J=J_r+J_l$, $d_1=c_l+c_r$ and $d_0$ captures the coulomb friction effect. Note that the simplified second order model in the form of (9) is equivalent to the form of (6), and the form (9) is suitable to formulate the parameter estimation as a least squares problem.

The simplified second order model (9) can be rewritten as the following linear regression formula:

$$\ddot{x}(t)=\underbrace{[\,1\quad -\dot{x}(t)\quad u(t)\,]}_{\Psi(t)}\underbrace{\frac{1}{MR^2+J}\begin{bmatrix}R^2d_0\\R^2d_1\\R\end{bmatrix}}_{\theta} \tag{10}$$

A concise representation of the linear regression formula is $$\ddot{x}(t)=\Psi(t)\theta.$$

With $\ddot{x}(t)$ and $\Psi(t)$ measured or estimated, estimation of $\theta$ is reduced to a least squares problem $$\min_{\theta}\|\ddot{x}(t)-\Psi(t)\theta\|_2.$$

Alternative linear regression form is $$u(t)=\underbrace{[\,1\quad -\dot{x}(t)\quad \ddot{x}\,]}_{\Psi(t)}\underbrace{\frac{1}{R}\begin{bmatrix}R^2d_0\\R^2d_1\\MR^2+J\end{bmatrix}}_{\theta}. \tag{11}$$

Assuming u(t) and $\Psi(t)$ are known, the parameter estimation is formulated as a least squares problem according to the linear regression formula (11). That is to find $\theta^*$ by solving the following optimization problem:

$$\min_{\theta}\|u(t)-\Psi(t)\theta\|_2.$$

Given linear regression formulas, numerous least squares (LS) or reclusive least squares (RLS) solvers can be used to produce estimates of $\theta$, on the basis of which the physical parameter $M,d_0,d_1$ can be uniquely determined. However, inappropriate uses of existing estimation algorithms can result in inaccurate or biased estimation.

Accordingly, some embodiments modify least squares algorithms to accurately estimate parameters $d_0,d_1,M$ from positions and/or torque measurements x and u. Because only the filtered door position x and the filtered motor torque u are measured, some embodiments reconstruct the filtered door acceleration $\ddot{x}$ and the filtered door velocity x from the measurements to form $\Psi(t)$. A number of different filters are used by the embodiments to estimate $\dot{x}$ and $\ddot{x}$ from x, such as sliding-mode-based filter and a high-gain-based filter.

One embodiment uses the high-gain-based high-bandwidth low pass filter $G_f$ defined by following differential equations $$\frac{d}{dt}\begin{bmatrix}\xi_1\\\xi_2\\\xi_3\end{bmatrix}=\begin{bmatrix}0&1&0\\0&0&1\\-\lambda^3&-3\lambda^2&-3\lambda\end{bmatrix}\begin{bmatrix}\xi_1\\\xi_2\\\xi_3\end{bmatrix}+\begin{bmatrix}0\\0\\\lambda^3\end{bmatrix}x_1(t),$$

$$\hat{x}=\xi_1,$$

$$\hat{\dot{x}}=\xi_2,$$

$$\hat{\ddot{x}}=\xi_3$$

where $\lambda$ is the value of poles of the filter, and is taken much larger than the dominant frequency of the simplified second order model, e.g., $\lambda>100$, $\hat{x}=\xi_1$ is the second filtered position, $\dot{\hat{x}}=\xi_2$ is the filtered velocity, and $\ddot{\hat{x}}=\xi_3$ is the filtered acceleration.

Alternative embodiment also applies the filter $G_f$ to the electric motor torque to ensure that the equality of linear regression formula holds. The embodiment reconstructs the second filtered torque signal from u by the following filter (which has the exactly same expression as $G_f$)

$$\frac{d}{dt}\begin{bmatrix}\zeta_1\\ \zeta_2\\ \zeta_3\end{bmatrix}=\begin{bmatrix}0 & 1 & 0\\ 0 & 0 & 1\\ -\lambda^3 & -3\lambda^2 & -3\lambda\end{bmatrix}\begin{bmatrix}\zeta_1\\ \zeta_2\\ \zeta_3\end{bmatrix}+\begin{bmatrix}0\\ 0\\ \lambda^3\end{bmatrix}u(t),$$

$$\hat{u}=\zeta_1$$

where $\hat{u}=\zeta_1$ is the second filtered torque signal.

Thus the aforementioned linear regression formulae (10) and (11) are rewritten as follows $$\zeta_3(t)=\underbrace{[\,1\quad -\xi_2(t)\quad \zeta_1(t)\,]}_{\Psi(t)}\theta$$

and $$\zeta_1(t)=\underbrace{[\,1\quad -\xi_2(t)\quad \xi_3\,]}_{\Psi(t)}\theta,$$

respectively.

The aforementioned least squares problem formulations assume measurement errors on the left hand side of (10) or (11), which can be suboptimal if the used sensors generating $\Psi(t)$ are not of high quality. To that end, one embodiment formulates the model parameter estimation as a total least squares problem. That is, taking (11) as an example, instead of instead of solving (11), the embodiment solves the following problem $$\min_{\theta,\delta u(t),\delta\Psi(t)}\|[\delta u(t),\ \delta\Psi(t)]\|_p,$$

subject to $$u+\delta u=(\Psi+\delta\Psi)\theta$$

where $\|[\delta u(t),\delta\Psi(t)]\|_p$ represents p—norm of the vector $[\delta u(t),\ \delta\Psi(t)]$. Usually, p=2.

Figure 5A:
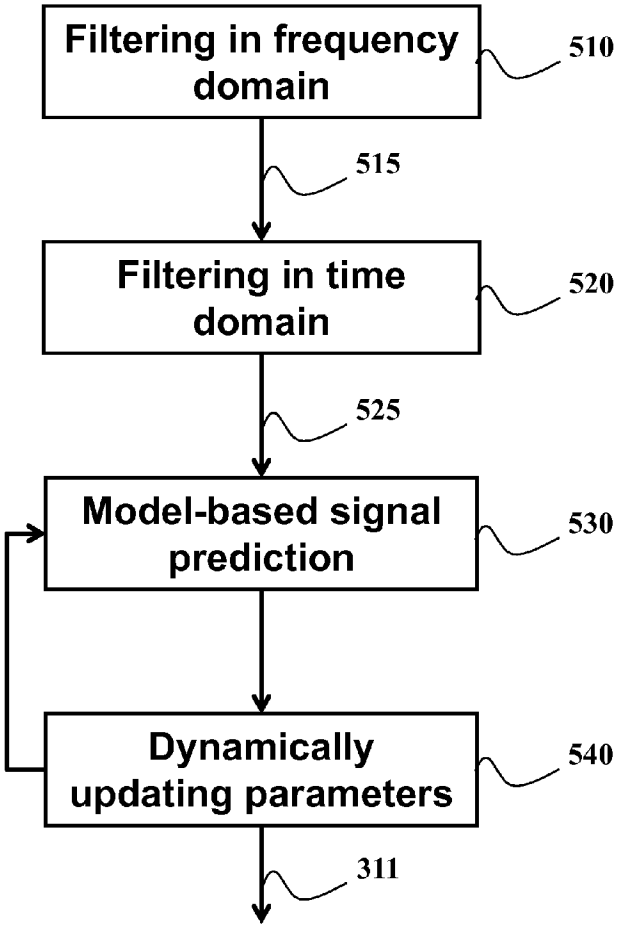
FIG. 5A is a block diagram of the parameter estimation method according to one embodiment of the invention.

FIG. 5A shows a block diagram of the parameter estimation method according to one embodiment of the invention. This embodiment filters the measured signal not only in frequency domain 510 but also in a time domain 520 to further suppress the influence of the model mismatch and noisy measurements. This embodiment is based on recognition that a model mismatch between the filtered signals and the simplified second order model is mainly due to nonlinearity of friction effect at low velocity regions, i.e., and the noisy measurements happen during the region when sensed signals 312 have small amplitude, such that the values of the measured position/torque signals are below a corresponding threshold.

Thus, the embodiment can improve accurate estimation of model parameters by removing the samples of measurements corrupted by the model mismatch and sensor noises. Accordingly, the embodiment filters 510 the signal in a frequency domain to produce an intermediate signal 515 and filters 520 the intermediate signal in a time domain to produce the filtered signal 525.

Figure 5B:
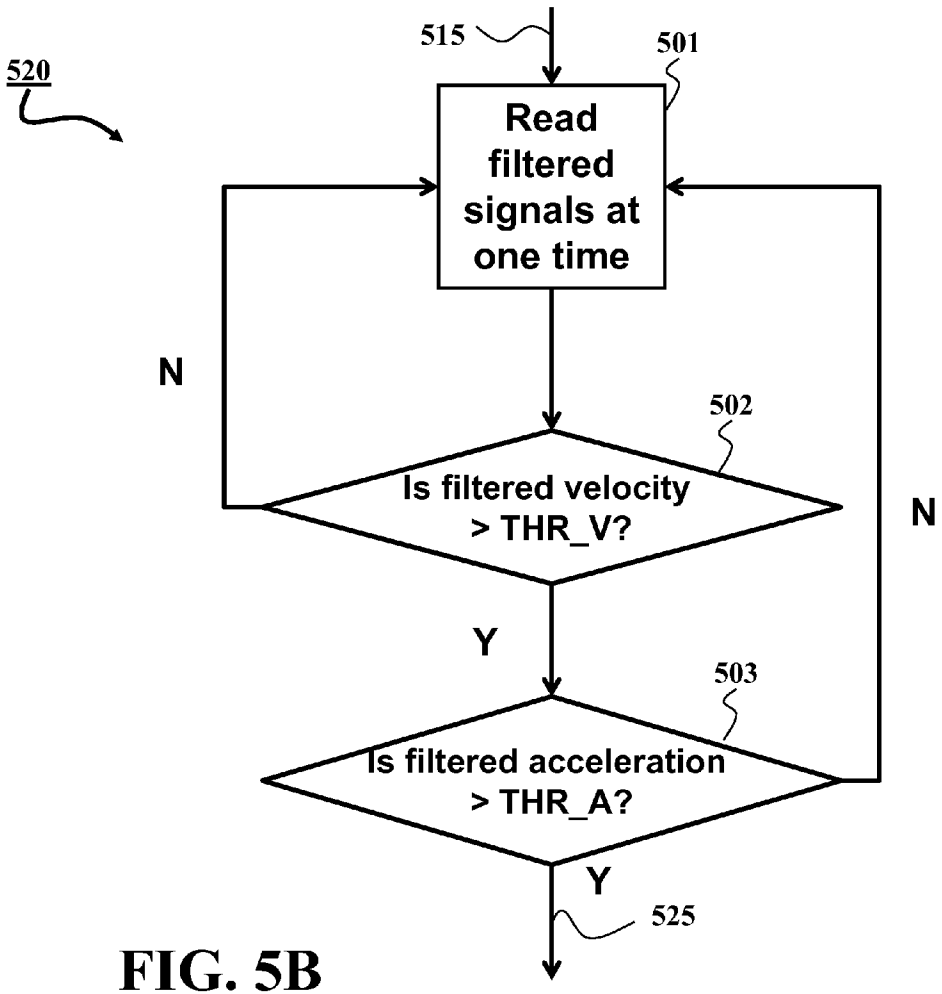
FIG. 5B is a block diagram of a method for filtering the signal in time domain according to one embodiment of the invention.

FIG. 5B shows a block diagram of a step 520 for filtering the signal in time domain according to one embodiment of the invention. At each time step, a block 501 reads and sends intermediate signal 515 to block 502 testing if the sampled data is noisy based on the following criteria. If the amplitude of the filtered velocity is larger than a certain positive threshold $THR_V$, the sampled data is acceptable for model reconstruction. Otherwise, the sampled data is noisy. In one implementation, the signal 515 is further processed in time domain by a block 503 which tests if the amplitude of the filtered acceleration is larger than a certain positive threshold $THR_A$, otherwise, the sampled data is noisy. The resulted filtered signal 525 is used for iterative model-based signal estimation 530 and dynamic update 540 of the parameters of the model. The values of the threshold $THR_I$, and threshold $THR_A$ can be determined, e.g., based on sensor resolution, signal to noise ratio of output of the sensor, and operation condition of the door system.

Figure 6:
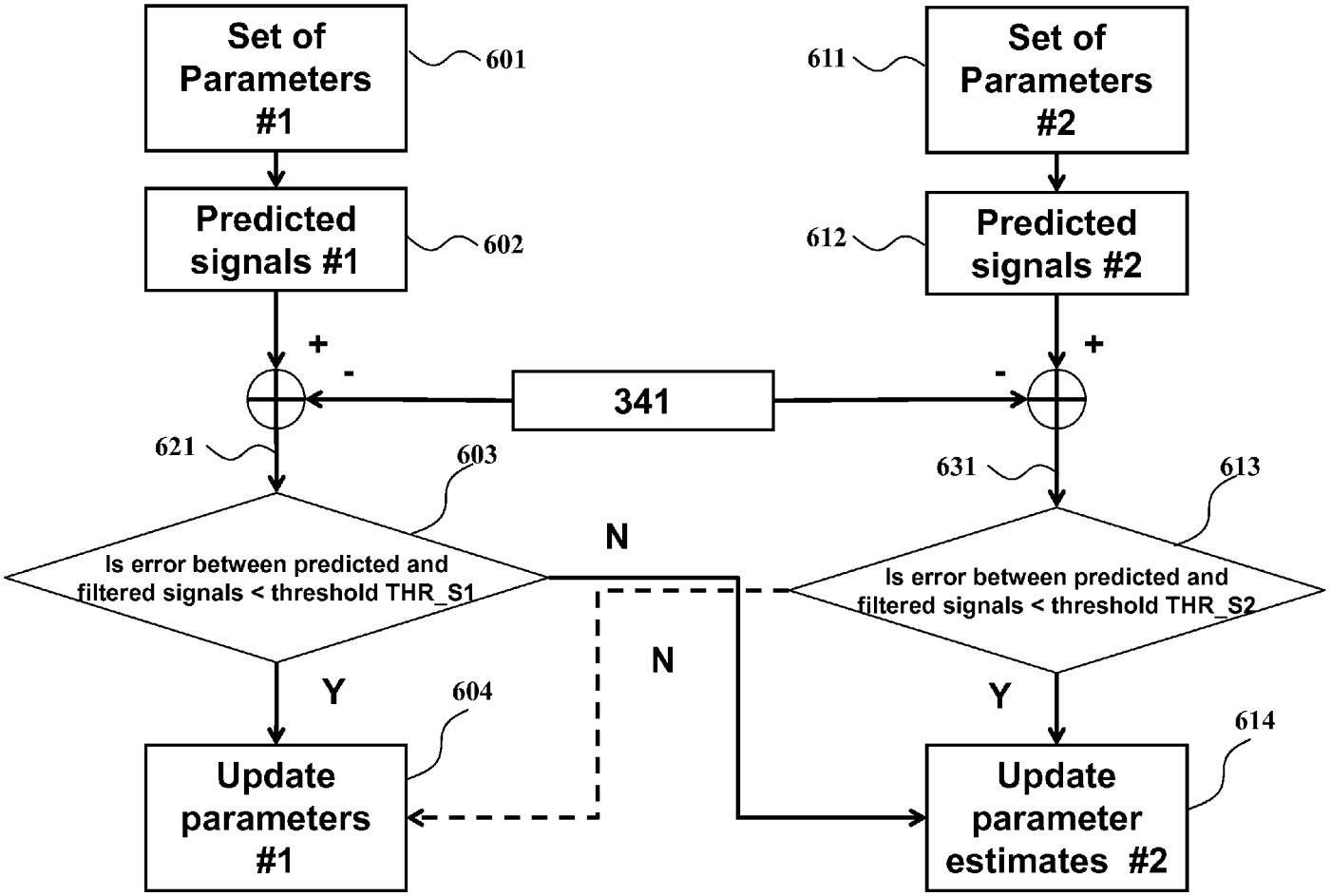
FIG. 6 is a block diagram of a method of one embodiment of parameter estimation for cases where values of model parameters of the elevator door system switches at certain times.

FIG. 6 shows a block diagram of a method of one embodiment of parameter estimation for cases where values of model parameters of the elevator door system switches at certain times. To that end, in some embodiments, the parameters of the reduced order model of the door system include at least two sets of parameters switching at an instant of time during the operation. For example, the sets of parameters include a first set of parameters 601 and a second set of parameters 611. The embodiment update 604 the first set of parameters 601 if the error 621 between the filtered signal 341 and the estimated signal of the operation estimated 602 using the reduced order model of the door system with the first set of parameters is below 603 a threshold. Otherwise, the embodiment updates 614 the second set of parameters.

Similarly, the embodiment update 614 the second set of parameters 611 if the error 631 between the filtered signal 341 and the estimated signal of the operation estimated 612 using the reduced order model of the door system with the second set of parameters is below 613 a threshold. Otherwise, the embodiment updates 604 the first set of parameters.

Figure 7:
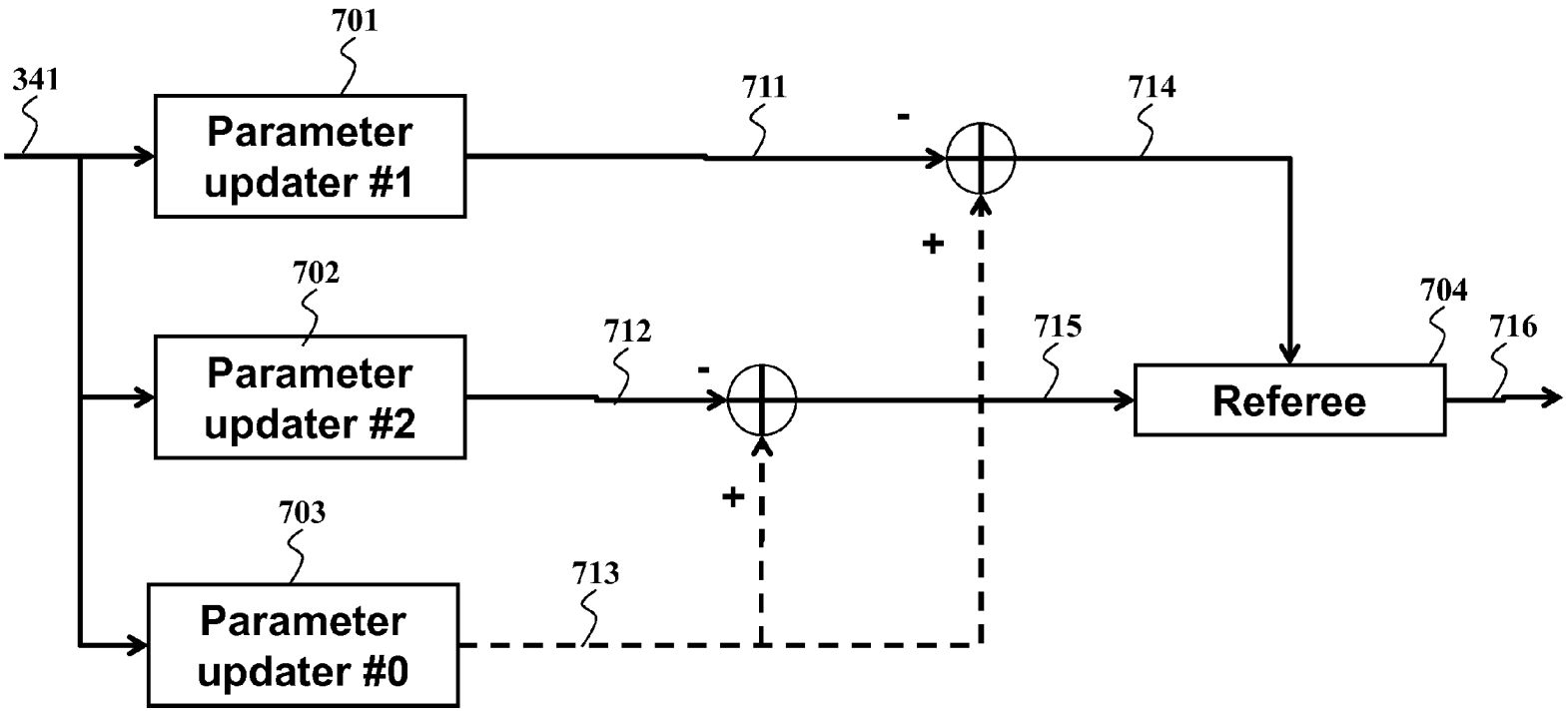
FIG. 7 is a block diagram of a method for parameter estimation according to another embodiment of the invention.

FIG. 7 shows a block diagram of a method for parameter estimation for cases where values of model parameters of the elevator door system switches at certain times according another embodiment of the invention. This embodiment determines the errors between the filtered signal and the estimated signal estimated with the first and with the second set of parameters and selects the parameters of the first or the second set of parameters as a set of parameters corresponding to a smaller error.

For example, the parameter updater #0, labeled 703, estimates parameters based on a short memory of filtered signals 341 (one way to implement this is to use a small forgetting factor in standard recursive least squares algorithms). On the other hands, the parameter updaters #1/#2, labeled 701 and 702 respectively, estimate parameters based on a long memory of filtered signals 341 (one way to implement this is to use a large forgetting factor in standard recursive least squares algorithms). Using an output of parameter updater 703 as benchmark, outputs of blocks 701 and 702, labeled as 711 and 712, are compared to 713, which yields absolute values 714 and 715 of error signals. A referee block 704, based on absolute values of 714 and 715, determines which parameter updater should run at the current step, and outputs decision signal as 716 to enable the parameter updater #1 or #2. One embodiment of output signal 711 is $\Psi(k)\hat{\theta}_1(k)$ with k the current time step and $\hat{\theta}_1(k)$ the parameter estimates of parameter updater #1, when the estimation algorithm is based on the regression formula (11). Another embodiment of output signal 711 could be the estimated value of parameter, such as elevator door mass.

The embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Computer-executable instructions may be in many forms, such as program modules, executed by one or more computers or other devices. Generally, program modules include routines, programs, objects, components, data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

The invention claimed is:

1. A method for controlling an operation of a door system of an elevator system arranged in a building, comprising:

controlling the operation of the door system using one or combination of parameters of a reduced order model of the door system, wherein the operation includes moving at least one door of the door system;

measuring a signal representing the operation of the door system;

filtering the measured signal by removing at least one dynamic of the measured signal absent from a frequency response of the reduced order model of the door system; and updating parameters of the reduced order model of the door system to reduce an error between the filtered signal and an estimated signal of the operation estimated using the updated reduced order model of the door system, wherein the parameters of the reduced order model include a mass parameter and a friction parameter, and wherein steps of the method are performed by a processor.

2. The method of claim 1, wherein the frequency response of the reduced order model approximates a dominant frequency response of a higher order model of the door system, wherein the dominant frequency response includes information about physical parameters of the door system to be estimated.

3. The method of claim 2, wherein the reduced order model is a second order model, and wherein the higher order model is at least an eighth order model, wherein an order of a model is a number of first order differential equations (DEs).

4. The method of claim 2, wherein the higher order model represents the door system including a motor, a pulley, a cabin door guarding an entrance to an elevator car and a landing door guarding an entrance to an elevator shaft, wherein the motor drives the pulley to move the cabin door using a belt, and wherein the cabin door is mechanically connected to the landing door when the elevator car stops at the floor of the building to move the landing door, further comprising:

simplifying the higher order model by ignoring dynamics of the pulley and by treating the belt as a rigid body to produce the reduced order model.

5. The method of claim 1, wherein the signal includes one or combination of a torque of a motor for moving the door and an acceleration of the movement of the door.

6. The method of claim 1, wherein the updating comprises:

determining the mass parameter by solving a least squared problem connecting the reduced order model and values of the filtered signal.

7. The method of claim 6, wherein the solving is according to $$\min_{\theta} \|u(t) - \Psi(t)\theta\|_2.$$

wherein θ is a decision variable, and u(t), Ψ(t) are signals inferred from measured signals.

8. The method of claim 6, wherein the solving is according to $$\min_{\theta,\delta u(t),\delta\Psi(t)} \|[\delta u(t), \delta\Psi(t)]\|_p,$$

subject to $$u + \delta u = (\Psi + \delta\Psi)\theta$$

wherein θ,δu(t),δΨ(t) are decision variables, $\|[\delta u(t),\delta\Psi(t)]\|_p$ is p—norm of a vector [δu(t),δΨ(t)], and u(t),Ψ(t) are signals inferred from measured signals.

9. The method of claim 1, wherein the filtering comprising:

filtering the measured signal by an order reduction filter to produce a filtered position of the door and a filtered torque of a motor moving the door; and filtering the filtered position and the filtered torque by a high bandwidth low pass filter to produce a filtered acceleration of the door and a filtered velocity of the door.

10. The method of claim 9, further comprising:

determining the parameters of the reduced order model by solving a least squared problem reducing the error between an estimated position of the door and the filtered position of the door, between an estimated acceleration of the door and the filtered acceleration of the door, between an estimated velocity of the door and the filtered velocity of the door, and between an estimated torque of the motor and the filtered torque of the motor.

11. The method of claim 1, wherein the controlling comprises:

determining a trajectory for moving the door for a cycle of the operation including opening and closing the door, wherein the trajectory defines a set of points describing a position and a velocity of the elevator door over time determined to reduce vibration of the door; and generating control commands to a motor for moving the door to track the trajectory.

12. The method of claim 1, wherein the filtering comprising:

filtering the signal is a frequency domain to produce an intermediate signal; and filtering the intermediate signal in a time domain to produce the filtered signal.

13. The method of claim 12, wherein the filtering in the time domain comprises:

comparing a sample of the intermediate signal with at least one threshold; and selecting the sample in forming the filtered signal if a value of the sample is greater than the threshold.

14. The method of claim 13, wherein the sample includes amplitudes of velocity and an acceleration of the elevator door.

15. The method of claim 1, wherein parameters of the reduced order model of the door system include at least two sets of parameters switching at an instant of time during the operation, wherein the sets of parameters include a first set of parameters and a second set of parameters, further comprising:

updating the first set of parameters if the error between the filtered signal and the estimated signal of the operation estimated using the reduced order model of the door system with the first set of parameters is below a threshold; and otherwise updating the second set of parameters.

16. The method of claim 1, wherein parameters of the reduced order model of the door system include at least two sets of parameters switching at an instant of time during the operation, wherein the sets of parameters include a first set of parameters and a second set of parameters, further comprising:

determining the errors between the filtered signal and the estimated signal estimated with the first and with the second set of parameters; and selecting parameters of the first or the second set of parameters as a set of parameters corresponding to a smaller error.

17. An elevator door system, comprising:

a motor and a pulley;

a cabin door guarding an entrance to an elevator car;

a landing door guarding an entrance to an elevator shaft, wherein the motor drives the pulley to move the cabin door using a belt, and wherein the cabin door is mechanically connected to the landing door for a period of time during an operation of the elevator door system;

sensors for measuring a signal representing the operation of the door system;

a filter for filtering the signal by removing at least one dynamic of the measured signal absent from a frequency response of a reduced order model of the elevator door system, wherein the frequency response of the reduced order model approximates a dominant frequency response of a higher order model of the door system; and a controller for controlling the operation of the elevator door system using the reduced order model of the elevator door system, wherein the controller updates parameter of the reduced order model to reduce an error between the filtered signal and an estimated signal of the operation estimated using the updated reduced order model of the door system.

18. The elevator door system of claim 17, wherein the filter filters the signal in time domain to remove samples of the signal at times when at least one of a velocity or an acceleration of the cabin door is below a threshold.

19. The elevator door system of claim 17, wherein parameters of the reduced order model of the door system include at least two sets of parameters switching at an instant of time during the operation, wherein the sets of parameters include a first set of parameters and a second set of parameters, such that the controller updates the first or the second set of parameters at an instant of time.

20. A method for controlling an operation of a door system of an elevator arranged in a building, wherein the door system includes a motor, a pulley, an elevator door guarding an entrance to an elevator car and a floor door guarding an entrance to a floor of the building, wherein the motor drives the pulley to move the elevator door, and wherein the elevator door is mechanically connected to the floor door when the elevator car stops at the floor of the building to move the floor door, comprising:

controlling the operation of the door system for an operating cycle using one or combination of parameters of a reduced order model of the door system, wherein the operating cycle includes one or combination of opening and closing the elevator and the floor doors;

measuring a signal of the operation of the door system;

filtering the signal by removing at least one dynamic of the measured signal absent from a frequency response of the reduced order model of the door system, wherein the frequency response of the reduced order model approximates a dominant frequency response of a higher order model of the door system; and updating parameters of the reduced order model of the door system to reduce an error between the filtered signal and a signal of the operation estimated using the updated reduced order model of the door system, wherein the parameters of the reduced order model include a mass parameter and a friction parameter.

* * * * *